US010806019B2

(12) United States Patent
De Neuter et al.

(10) Patent No.: US 10,806,019 B2
(45) Date of Patent: Oct. 13, 2020

(54) CYCLOTRON FOR EXTRACTING CHARGED PARTICLES AT VARIOUS ENERGIES

(71) Applicant: Ion Beam Applications S.A., Louvain-la-Neuve (BE)

(72) Inventors: Sébastien De Neuter, Louvain-la-Neuve (BE); Jean-Michel Geets, Louvain-la-Neuve (BE); Benoit Nactergal, Louvain-la-Neuve (BE); Vincent Nuttens, Louvain-la-Neuve (BE); Jarno Van De Walle, Louvain-la-Neuve (BE)

(73) Assignee: Ion Beam Application S.A., Louvain-la-Neuve (BE)

( * ) Notice: Subject to any disclaimer, the term of this patent is extended or adjusted under 35 U.S.C. 154(b) by 60 days.

(21) Appl. No.: 16/227,698

(22) Filed: Dec. 20, 2018

(65) Prior Publication Data

US 2020/0029421 A1 Jan. 23, 2020

(30) Foreign Application Priority Data

Dec. 21, 2017 (EP) ..... 17209226

(51) Int. Cl.
*H05H 13/00* (2006.01)
*H05H 7/10* (2006.01)

(52) U.S. Cl.
CPC ..... *H05H 13/005* (2013.01); *H05H 7/10* (2013.01)

(58) Field of Classification Search
CPC ..... H05H 13/005; H05H 7/10; H05H 7/00; G21K 5/08
See application file for complete search history.

(56) References Cited

U.S. PATENT DOCUMENTS 3,641,446 A 2/1972 Gordon
6,444,990 B1 * 9/2002 Morgan ..... G21G 1/10 250/396 R (Continued)

FOREIGN PATENT DOCUMENTS

EP 2129193 A1 12/2009

OTHER PUBLICATIONS

Extended European Search Report issued in corresponding European Patent Application 17209226.4 dated Jun. 8, 2018.

*Primary Examiner* — Wyatt A Stoffa
(74) *Attorney, Agent, or Firm* — Finnegan, Henderson, Farabow, Garrett & Dunner LLP

(57) ABSTRACT

A cyclotron for accelerating a beam of charged particles and extracting the beam. The cyclotron includes a vacuum chamber; a target support element sealed and coupled to the vacuum chamber and including a tubular channel leading to a target; first energy specific extraction kit including a first stripper assembly with a stripper located at a first stripping position for stripping charged particles at a first energy and a second energy specific extraction kit for driving modified charged particles of second energy along a second extraction path towards a target holder, wherein the energy specific extraction kit includes: a second stripper assembly with a stripper located at a second stripping position for stripping charged particles at a second energy and an insert for modifying an orientation of the tubular channel to match the second extraction path such that the modified charged particles of second energy intercept the target holder.

13 Claims, 5 Drawing Sheets

(56) References Cited

U.S. PATENT DOCUMENTS

| | | | | |
|---|---|---|---|---|
| 6,462,348 | B1 * | 10/2002 | Gelbart | G21K 1/093 250/505.1 |
| 8,653,762 | B2 | 2/2014 | Eriksson et al. | |
| 9,185,790 | B2 * | 11/2015 | Svedberg | H05H 13/005 |
| 9,723,706 | B2 * | 8/2017 | Svedberg | H05H 13/005 |
| 10,109,383 | B1 * | 10/2018 | Parnaste | G21G 1/0005 |
| 10,340,051 | B2 * | 7/2019 | Parnaste | H05H 7/001 |
| 2007/0040115 | A1 * | 2/2007 | Publicover | G01T 1/29 250/305 |
| 2011/0089335 | A1 * | 4/2011 | Colard | H05H 7/10 250/423 R |
| 2012/0161671 | A1 | 6/2012 | Eriksson et al. | |
| 2015/0077022 | A1 * | 3/2015 | Svedberg | H05H 13/005 315/502 |
| 2015/0305135 | A1 * | 10/2015 | Korenev | H05H 7/001 250/396 R |
| 2017/0004897 | A1 * | 1/2017 | Eriksson | G21G 1/10 |
| 2017/0236608 | A1 * | 8/2017 | Parnaste | H05H 13/005 376/190 |
| 2017/0332475 | A1 * | 11/2017 | Kleeven | H05H 7/10 |
| 2018/0322972 | A1 * | 11/2018 | Parnaste | H05H 6/00 |
| 2019/0110354 | A1 * | 4/2019 | Liang | H05H 7/12 |

* cited by examiner

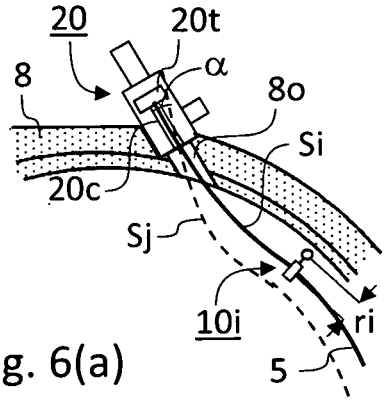
Fig. 6(a)
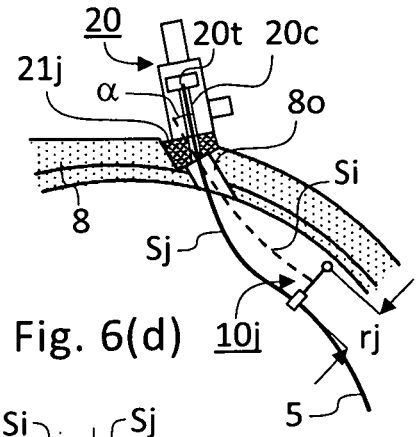
Fig. 6(d)
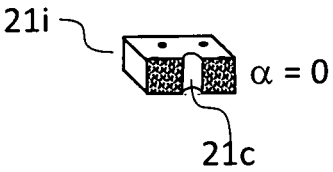
Fig. 6(b)
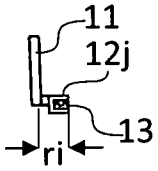
Fig. 6(c)
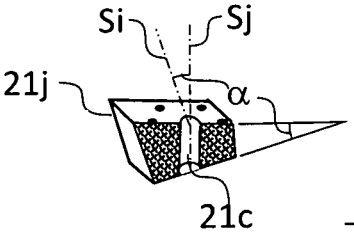
Fig. 6(e)
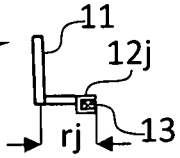
Fig. 6(f)
Fig. 7(a)
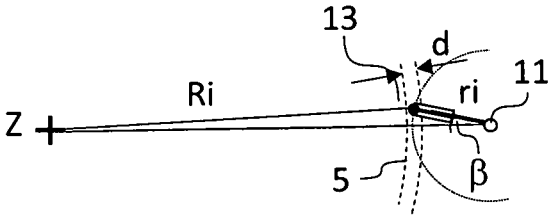
Fig. 7(b)
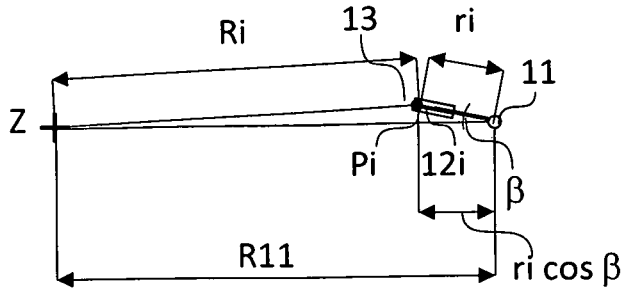

CYCLOTRON FOR EXTRACTING CHARGED PARTICLES AT VARIOUS ENERGIES

CROSS-REFERENCE TO RELATED PATENT APPLICATIONS

This application claims foreign priority of European Patent Application No. 17209226.4, filed Dec. 21, 2017, which is hereby incorporated by reference in its entirety.

TECHNICAL FIELD

The present disclosure concerns a cyclotron capable of extracting a spiraling beam of accelerated charged particles out of its spiral path at different energies and steering it towards a target, e.g., for producing specific radioisotopes. In particular, it concerns a cyclotron provided with an energy specific extraction kit for changing the extraction settings of the cyclotron such that particles can be extracted by stripping at a specific energy, Ei, or at a different energy, Ej, and can reach a target.

BACKGROUND

A cyclotron is a type of circular particle accelerator in which negatively or positively charged particles accelerate outwards from the center of the cyclotron along a spiral path up to energies of several MeV. There are various types of cyclotrons. In isochronous cyclotrons, the particle beam runs each successive cycle or cycle fraction of the spiral path in the same time. Cyclotrons are used in various fields, for example in nuclear physics, in medical treatment such as proton-therapy, or in nuclear medicine, e.g., for producing specific radioisotopes.

A cyclotron comprises several elements including an injection system, a radiofrequency (RF) accelerating system for accelerating the charged particles, a magnetic system for guiding the accelerated particles along a precise path, an extraction system for collecting the thus accelerated particles, and a vacuum system for creating and maintaining a vacuum in the cyclotron.

An energy specific extraction kit comprises a stripper assembly for extracting charged particles at the specific energy, Ej, and an insert for orienting the target to intersect the extraction path, Sj, followed by the particle beam after crossing the stripper. The energy specific extraction kit allows an easy change of the extraction settings of the cyclotron for hitting a target with particles of different energies. The energy specific extraction kit is cost-effective and comprises no articulated or otherwise delicate parts.

SUMMARY

The present disclosure concerns a cyclotron for accelerating a beam of charged particles, comprising $H^-$, $D^-$, $HH^+$, over an outward spiral path until the beam of charged particles reaches a desired energy, and for extracting the beam to hit a target, the cyclotron comprising:

- a vacuum chamber defined by a gap separating first and second magnet poles centered on a central axis, Z, and symmetrically positioned opposite to one another with respect to a median plane, P, normal to the central axis, Z, and by a peripheral wall (8), sealing the gap and allowing drawing of a vacuum in the gap, the peripheral wall comprising an opening;

- a target support element sealed and coupled to a downstream end of the opening (8*o*), outside the vacuum chamber, the target support element comprising a tubular channel in fluid communication with the opening and ending at a target holder for holding a target;
- a stripping mechanism for receiving and controlling a position of a first energy specific extraction kit including a first stripper assembly in the gap, the first stripper assembly comprising:
  - a first rotating axle provided with one or more first brackets, each one for holding a first stripper having an outer edge at a first distance, ri, from the first rotating axle such that the first rotating axle is parallel to the central axis, Z, and that the first stripper can rotate about the first rotating axle to a first stripping position, Pi, intercepting the beam of charged particles at a first energy, Ei, modifying the charge of the particles traversing the first stripper and steering the thus modified charged particles along a first extraction path, Si, through the opening in the peripheral gap wall, along the tubular channel, and towards the target holder; and
- a second energy specific extraction kit for driving a beam of modified charged particles of a second energy, Ej, along a second extraction path, Sj, through the opening in the peripheral wall, along the tubular channel, and towards the target holder, wherein the second energy specific extraction kit comprises:
  - a second stripper assembly including:
    - a second rotating axle provided with one or more second brackets, each one for holding a second stripper having an outer edge at a second distance, rj, from the second rotating axle such that the second stripper can rotate about the second rotating axle to a second stripping position, Pj, intercepting the beam of charged particles at the second energy, Ej, modifying the charge of the particles traversing the second stripper and driving the thus modified charged particles along a second modified path, Sj, through the opening in the peripheral wall; and
  - an insert to be sandwiched between a downstream end of the opening (8*o*) and the target support element with an insert channel in fluid communication with both the opening and the tubular channel, for modifying an orientation of the tubular channel to match the second extraction path, Sj, such that the modified charged particles of second energy, Ej, intercept the target holder.

The present disclosure also concerns a method for hitting a target with a particle beam of second energy, Ej, comprising the steps of:

- providing a cyclotron designed for extracting a particle beam of a first energy, Ei, and steering the particle beam towards a target, the cyclotron comprising:
  - a vacuum chamber comprising an opening,
  - a target support element comprising a target holder,
  - a stripping mechanism comprising a first energy specific extraction kit including a first stripper assembly, and
  - a second energy specific extraction kit comprising a bracket, a second stripper assembly, a stripper, and an insert,
- removing the first stripper assembly and removing the target support element,
- mounting the bracket and positioning the stripper at a stripping position, Pj, mounting the target support element with the insert sandwiched between a downstream end of the opening and the target support element, positioning the target in the target holder; and accelerating a particle beam along a spiral path intersecting the stripping position, Pj, at the second energy, Ej, and extracting the particle beam along an extraction path, Sj, through the opening and onto the target.

BRIEF DESCRIPTION OF THE FIGURES

For a fuller understanding of the nature of the present disclosure, reference is made to the following detailed description taken in conjunction with the accompanying drawings in which:

FIGS. 5(*a*)-5(*c*) show a side view and top views of a stripper assembly at the first energy, Ei. FIGS. 5(*d*)-5(*f*) show a side view and top views of a stripper assembly at the second energy, Ej FIGS. 6(*a*)-6(*f*) show energy specific extraction kits for extracting a particle beam. FIGS. 6(*a*)-6(*c*) show the energy specific extraction kit at the first energy, Ei. FIGS. 6(*d*)-6(*f*) show the energy specific extraction kit at the second energy. The dashed lines indicate the orbits of beams of energies extracted with the other striper assembly for comparative purposes.

FIGS. 7(*a*) and 7(*b*) show positioning of the stripper assembly with respect to the central axis, Z.

DETAILED DESCRIPTION

The present disclosure concerns accelerated particle beam extraction systems for extracting out of the acceleration gap of a cyclotron a beam of charged particles such as $H^-$, $D^-$, $HH^+$, at a first energy, Ei, and steering the extracted beam towards a target, for the production of radioisotopes. The energy, Ei, of the extracted particle beam can be between 5 and 30 MeV, or, in alternative embodiments, between 10 and 24 MeV, or between 11 and 20 MeV. The cyclotron can be an isochronous cyclotron or a synchrocyclotron. The target (20*t*) can be solid, liquid, or gaseous.

Figure 1A:
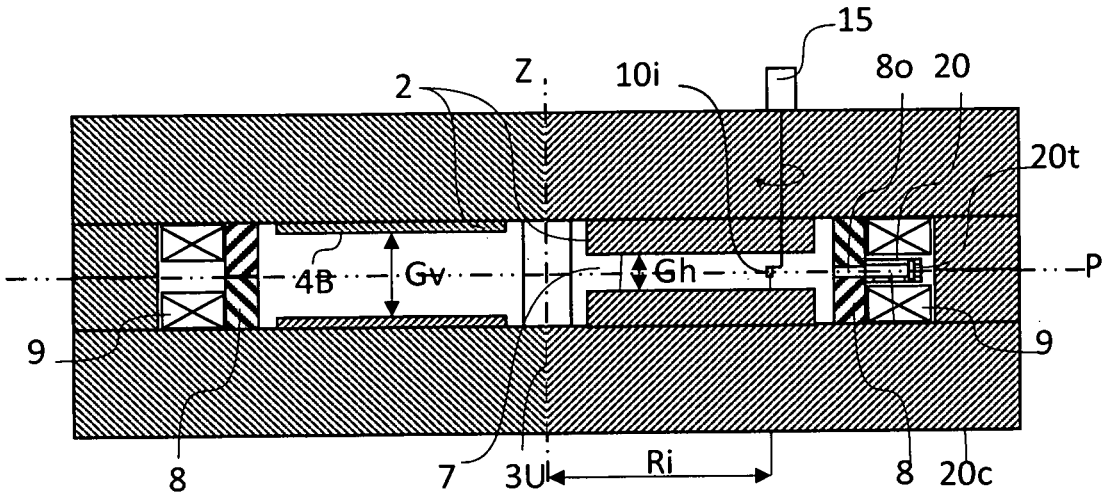
FIGS. 1(*a*) and 1(*b*) show a cyclotron, in which FIG. 1(*a*) shows a cross section of a cyclotron, and FIG. 1(*b*) shows a perspective view of one half of the cyclotron with respect to the median plane, P.
Figure 1B:
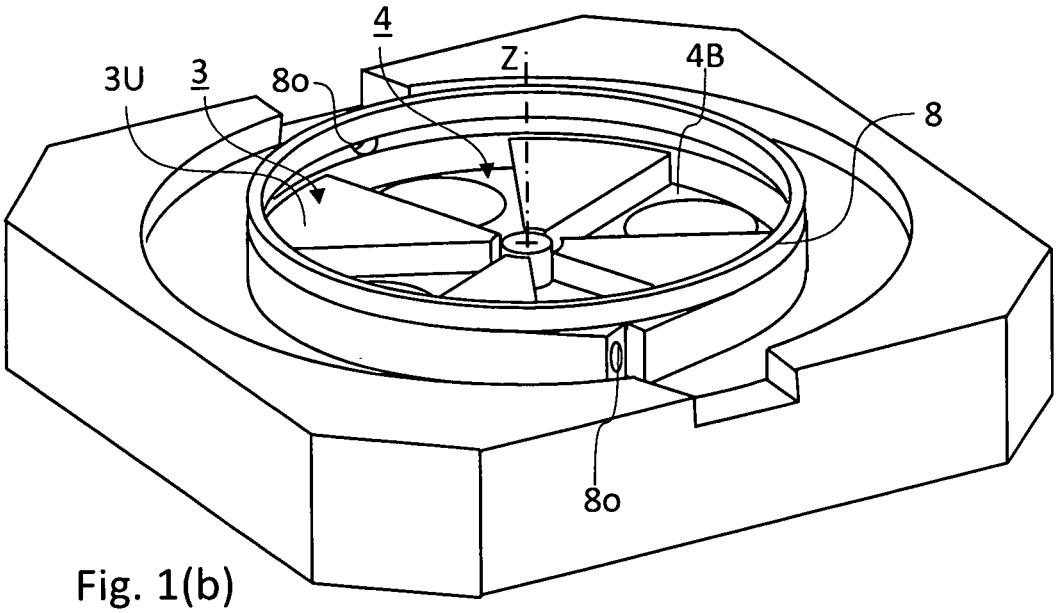

With reference to FIGS. 1(*a*) and 1(*b*) which illustrate a cyclotron according to the present disclosure, an injection system introduces a particle beam with a relatively low initial velocity into an acceleration gap (7) at or near the center of the cyclotron. The RF accelerating system sequentially and repetitively accelerates this particle beam, guided outwards along a spiral path (5) within the acceleration gap by a magnetic field generated by the magnetic system.

The magnetic system generates a magnetic field that guides and focuses the beam of charged particles along the spiral path (5) until reaching its target energy, Ei. The magnetic field is generated in the acceleration gap (7) defined, e.g., between two magnet poles (2), by one or more solenoid main coils (9) wound around these magnet poles, as illustrated in FIG. 1(*a*).

The main coils (9) are enclosed within a flux return, which restricts the magnetic field within the cyclotron. Vacuum is extracted from a vacuum chamber defined by the acceleration gap (7) and a peripheral wall (8) sealing the acceleration gap (7). The peripheral wall is provided with at least one opening (8*o*) for allowing extraction of the beam out of the gap.

When the particle beam reaches its target energy, Ei, the extraction system extracts it from the cyclotron at a point of extraction and guides it towards an extraction channel through the opening (8*o*) in the peripheral wall. Several extraction systems exist and are known to a person of ordinary skill in the art.

In the present disclosure the extraction system comprises a stripper (13) consisting of a thin sheet, e.g., made of graphite, capable of extracting charges from particles impacting the stripper, thus changing the charge of the particles, and changing their path leading them out of the cyclotron through the opening and along an extraction channel. A stripper is generally part of a stripper assembly (10*i*) comprising a bracket (12*i*) for holding the stripper at a specific distance, ri, from a rotating axle (11). The rotating axle is rotatably mounted within the acceleration gap (7) and can be rotated to bring the stripper in and out of a colliding position, Pi, with a beam of accelerated particles of energy, Ei, as described e.g., in U.S. Pat. No. 8,653,762. As described in EP2129193, more than one stripper can be mounted on a single rotating axle, for bringing a new stripper in colliding position in case of damage of the stripper in place.

After stripping of one or more charges, the particle beam is steered by the magnetic field in the vacuum chamber along an extraction path, Si, of opposite curvature to the spiraling path, leading it through the opening (8*o*), along a tubular channel (20*c*) of a target support element (20), and onto a target (20*t*) held within or at an end of the tubular channel. For the production of radioisotopes, the target (20*t*) can be solid, liquid or gaseous. A person of ordinary skill in the art knows how a target can be held in irradiating position depending on whether it is solid, liquid or gaseous.

Figure 3:
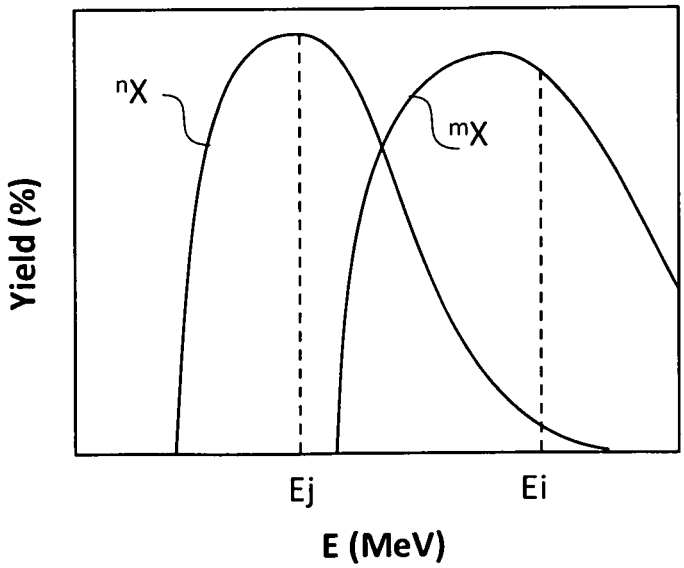
FIG. 3 shows an example of yield of two radioisotopes $^{n}X$, $^{m}X$, as a function of an energy, E, of the particle beam hitting a target, and corresponding optimal energies, Ei, Ej, for producing one or the other radioisotopes.

The production of a specific radioisotope for imaging and other diagnostic methods, or for biomedical research, by irradiating a given target material with a beam of accelerated particles depends on the energy of the particle beam. As illustrated in FIG. 3, a same target material may yield different radioisotopes, $^{n}X$, $^{m}X$, depending on the energy of the impacting particle beam. In the Example illustrated in FIG. 3, the target material should be irradiated with a particle beam of first energy, Ei, to yield a radioisotope, $^{m}X$, and of second energy, Ej, to yield radioisotope, $^{n}X$. The dependency of the type of radioisotope produced on the particle beam energy is described, e.g., in US20070040115.

Most cyclotrons are designed for extracting a particle beam at a single value of energy. A stripper located at a first stripping position, Pi, is crossed by particles of first energy, Ei, and does not intercept particles of second energy, Ej≠Ei, travelling at a different radial orbit in the spiral path. For intercepting particles of second energy, Ej, the stripper is moved to a second stripping position, Pj≠Pi. A stripper can be mounted on a moving element, e.g., on a rail or a telescopic arm, to move the stripper from a first radial stripping position, Pi, to any second radial stripping position. When the stripper is moved to the second stripping position, Pj, the extraction path of the stripped particles of second energy, Ej, is deviated with bending magnets at the crossover point of the extraction path of the beam of first energy, Ei, to reach their target. Such systems are available on the market and operational, but they increase the complexity and cost of a cyclotron.

The position of the target (20*t*) intercepts the extraction path, Si, Sj, of the particle beam. As discussed above, the extraction path of the particle beam can be deviated with bending magnets, but they render the system more complex. For production of radioisotopes for biomedical research and diagnostic medicine, typically imaging, it is preferred to locate the target (20*t*) close to the opening (8*o*) and position the target at an intersecting position with the particle beam without requiring any additional steering means for deviating the beam towards the target.

Variable energy cyclotrons are available on the market, equipped with an articulated multi-holder target support. It is believed that bending magnets are required to steer the particle beam towards a given holder. Such articulated multi-holder target supports are bulky and complex to handle. Handling the position of a target to make it intercept a high energy particle beam can be not only cumbersome, but dangerous, with a risk of damaging equipment and, possibly, injuring an operator.

There therefore remains a need for a cyclotron which can be operated for extracting a particle beam at two or more different values of energies, Ei, Ej, for the production of radioisotopes, which is of simple and economical design compared with single energy cyclotrons, which is foolproof, and requiring no additional bending magnets. The present disclosure proposes a cyclotron provided with an energy specific extraction kit allowing an easy change of the extraction settings of the cyclotron for hitting a target with particles of different energies.

As illustrated in FIG. 1, the cyclotron according to the present disclosure comprises a vacuum chamber defined by the acceleration gap (7) separating first and second magnet poles (2) centered on a central axis, Z, and symmetrically positioned opposite to one another with respect to a median plane, P, normal to the central axis, Z, and by the peripheral wall (8), sealing the gap and allowing drawing of a vacuum in the acceleration gap, the peripheral wall comprising the opening (8*o*).

Figure 2:
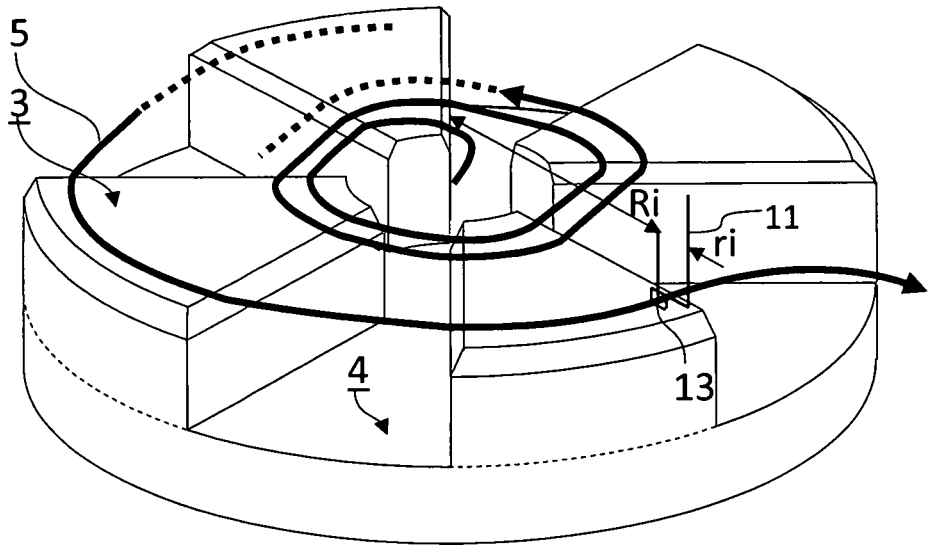
FIG. 2 shows the trajectory of a particle beam in the cyclotron and an extraction path after crossing a stripper.

A cyclotron comprises one or more main coils coiled around the first and second magnet poles, for generating a main magnetic field in the acceleration gap and outwardly guiding the accelerated charged particles along the spiral path (5) (cf. FIG. 2). An injection unit (not shown) allows the insertion into the acceleration gap (7) of charged particles at a central portion of the first and second magnet poles. A set of dees (not shown) is provided for accelerating the charged particles by application of a radio frequency (RF) alternating voltage in the acceleration gap (7).

Figure 4A:
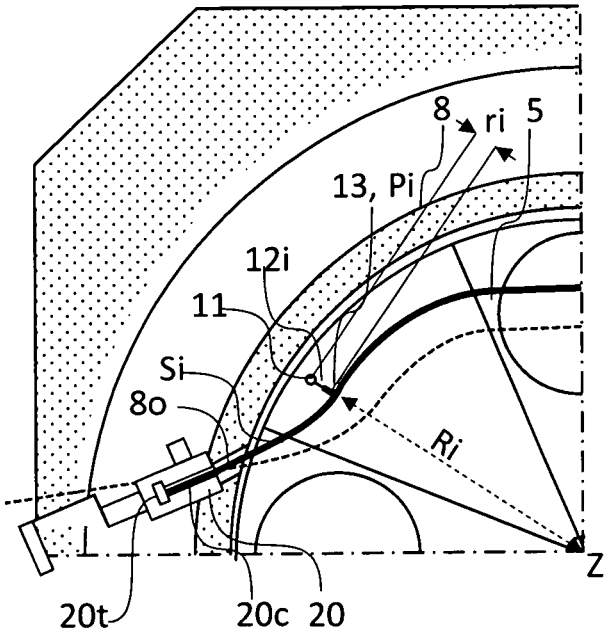
FIGS. 4(*a*) and 4(*b*) show top views of the cyclotron equipped with an energy specific extraction kit according to the present disclosure, with the trajectory of a particle beam indicated with a thick solid line, in which FIG. 4(*a*) shows the first energy, Ei, and FIG. 4(*b*) the second energy, Ej; wherein the dashed indicate the orbits of beams of energies extracted with the other striper assembly for comparative purposes.
Figure 4B:
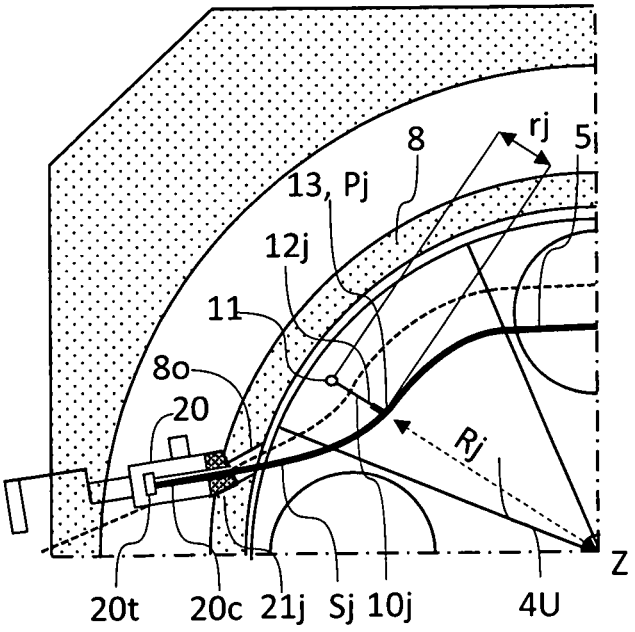
Figure 5A:
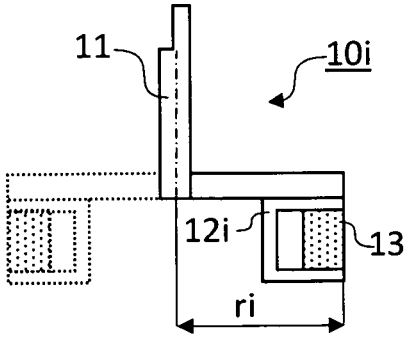
FIGS. 5(*a*)-5(*f*) show side views and top views of stripper assemblies for extracting a particle beam.
Figure 5D:
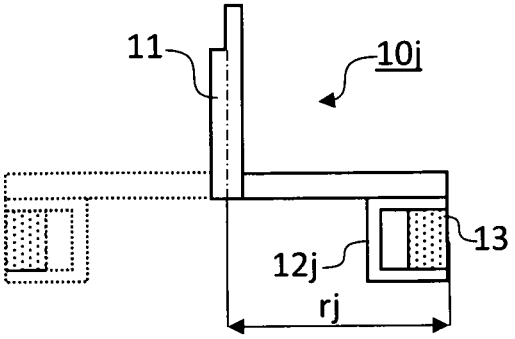
Figure 5B:
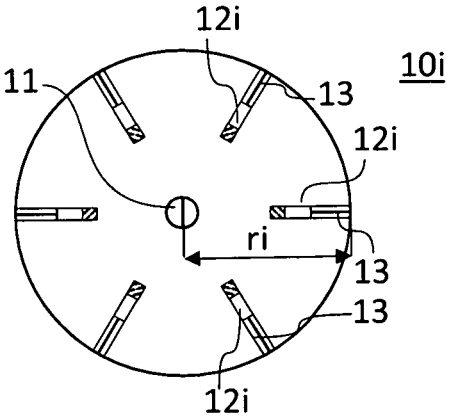
Figure 5E:
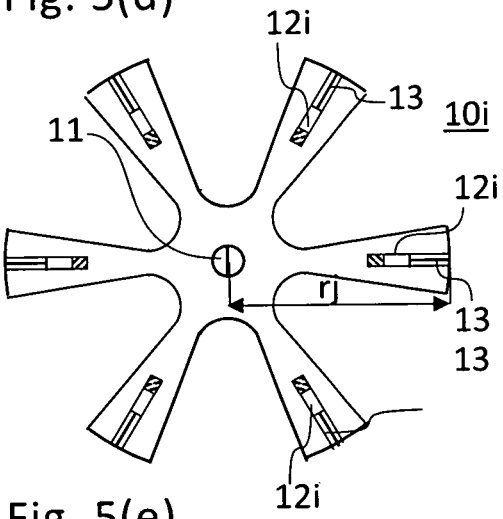
Figure 5C:
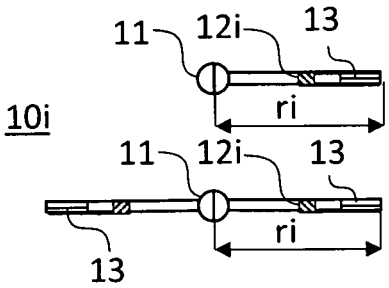
Figure 5F:
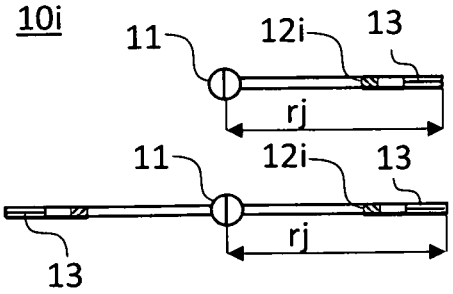

As shown in FIGS. 4(*a*), 4(*b*), 6(*a*), and 6(*d*), the target (20*t*) is held in irradiation position in the target support element (20) sealed and coupled to a downstream end of the opening (8*o*), outside the vacuum chamber. The target support element comprises a tubular channel (20*c*) in fluid communication with the opening and ending at a target holder for holding the target (20*t*).

For extracting a particle beam out of the spiraling path (5) it follows in the acceleration gap (7), and steering it towards the target (20*t*), the stripper (13) is positioned at a first stripping position, Pi, intersecting the particle beam at a first radial distance, Ri, from the central axis, Z, corresponding to the desired beam first energy, Ei. A stripper generally consists of a carbon stripping foil capable of extracting one or more electrons from the charged particles of energy, Ei, crossing it. For example, a negative ion, $^1H^-$ can be accelerated to a first energy, Ei. Upon crossing the stripper, a pair of electrons is removed (stripped), making the particle a positive ion, $^1H^+$. The stripped particle deviates from the spiraling path (5), is steered along the extraction path, Si, exits through the opening (8*o*) and reaches the target (20*t*). The extraction path, Si, depends on the local value of the magnetic field, B, and on the charge, q, of the stripped particle (assuming a constant velocity, vi, and mass, m).

A stripper can be mounted on a bracket (12*i*) by means known to a person of ordinary skill in the art. The stripper is held by the bracket (12*i*) such that an outer edge of the stripper most remote from the rotating axle is held at a distance, ri, from a rotating axle (11). The distance, ri, is the distance from the outer edge of the exposed surface of stripper to the rotating axle (11). The rotating axle (11) is mounted in the gap, near a peripheral edge of the magnet poles, parallel to the central axis, Z, such that the stripper (13) can rotate about the rotating axle in and out of the first stripping position, Pi, intercepting the beam of charged particles at the first energy, Ei.

As illustrated by dashed lines in FIG. 7(*a*), the particle beam (5) has a cross-sectional diameter, d. The stripper (13) is positioned to intercept the particle beam (5) by rotation thereof about the rotational axle (11), which is positioned at a radial distance, R11, from the central axis, Z. Rotation of the rotational axle (11) is generally driven by a motor (15) as illustrated in FIG. 1(*a*), which can be controlled very accurately by a controller. The stripper (13) and bracket (12*i*) need not be aligned with the cyclotron radius passing by the rotational axle (11), and can form an angle, β, therewith, as long as the stripper outer edge intercepts the particle beam of cross-sectional diameter, d (compare dashed lines in FIG. 7(*a*) representing the beam (5), with the dotted line representing the rotation of the stripper outer edge about the rotational axle (11)). As illustrated in FIG. 7(*b*), and based on simple geometrical considerations, the distance, Ri, of the stripper outer edge to the central axis, can be expressed as, $Ri=(R11^2+ri^2-2\ ri\ R11\ \cos\beta)^{1/2}$. The distance, ri, of the rotating axle (11) to the stripper outer edge can be substantially smaller than its distance, R11, to the central axis, Z. For example, ri/R11<10%, or, in alternative embodiments, ri/R11<5%. With ri/R11<10%, the distance, Ri, of the stripper outer edge to the central axis, Z, can be approximated within 1%-tolerance by, Ri≅R11−ri, for values of the angle β comprised within ±23°. Note that R11 is greater than Ri, (R11>Ri), because the rotating axle must not intercept the particle beam before the beam reaches the stripper.

The extraction settings, including the positions of the stripper (13), of the outlet (8*o*) and of the target (20*t*), are selected such as to steer the extraction path, Si, followed by the particle beam after stripping through the opening (8*o*), along the tubular channel (20*c*) of the target support element (20) and onto the target (20*t*) held in the target holder. A person of ordinary skill in the art can calculate the extraction settings for steering a particle beam of first energy, Ei, towards the target. For fine tuning and optimizing the relative position of the extraction path, Si, with respect to the target (20*t*), the stripping point, Pi, can be slightly displaced by minute rotations of the stripper (13) about the rotational axle, as discussed earlier with respect to FIG. 7. The target support element (20) can also comprise means for fine tuning the position of the target, but rotation of the stripper alone is normally sufficient to optimize the relative position of the extraction path, Si, with respect to the target.

A cyclotron is generally designed for extracting charged particles at a single first energy, Ei, because changing the extraction settings for extracting a particle beam at a second energy, Ej, is quite complex. Cyclotrons allowing extraction of particle beams at different energies are available on the market, but they are very complex with, on the one hand, specific devices for changing the position of the stripper and, on the other hand, additional devices either for bending the extraction path after stripping with bending magnets to steer it towards the target, or for moving the target in an articulated target support element. The drawback with these cyclotrons is that they are complex, expensive, and delicate. Furthermore, there is no automatic coupling of the position of the stripper with the bent extraction path, nor the position of the target. When fine tuning of the intersecting point of the extraction path with the target is allowed for an optimal use of the cyclotron, experimenting with a new extraction path, without any accurate knowledge of the resulting extraction path of a 10 to 30 MeV particle beam, is dangerous for the equipment and for the operators. Such cyclotrons are therefore not fool-proof, and a handling error while changing the extraction settings can have dire consequences.

The present disclosure provides one or more energy specific extraction kits for extracting a particle beam at a second or additional energies, Ej, from a same cyclotron designed for extracting a particle beam at a first energy, Ei. With reference to FIGS. 5(*a*)-6(*e*), a second energy specific extraction kit according to the present disclosure for extracting a particle beam at a second energy, Ej, different from the first energy, Ei, (Ej≠Ei) comprises a second stripper assembly (10*j*), and an insert (21*j*).

Stripper Assembly

The second stripper assembly (10*j*) comprises: a second rotating axle (11) provided with one or more second brackets (12*j*) each for holding a second stripper (13) centered at a second distance, rj, from the second rotating axle.

The second stripper assembly (10*j*) is such that the second stripper (13) can rotate about the second rotating axle (11) to a second stripping position, Pj, intercepting the beam of charged particles at the second energy, Ej. The particle beam of second energy, Ej, crossing the stripper is depleted of some electrons and is steered by the magnetic field in the gap along a second modified path, Sj, through the opening (8*o*) in the peripheral wall.

FIGS. 5(*a*)-5(*f*) illustrate examples of stripper assemblies (10*i*, 10*j*). FIGS. 5(*a*)-5(*c*) show the first stripper assemblies (10*i*) for extracting a particle beam at the first energy, Ei. FIGS. 5(*d*)-5(*f*) show the second stripper assemblies (10*j*) for extracting a particle beam at the second energy, Ej. The outer edge of the exposed area of the stripper (13) is held at a distance, ri or rj, from the rotating axle (11) by a bracket (12*i* or 12*j*). The bracket comprises a frame-like structure for fastening the stripper and fixed to an arm or plate for keeping the thus fastened stripper at an accurate distance, ri or rj, from the rotating axle (11). As shown in FIGS. 5(*c*) and 5(*f*), a stripper assembly can comprise a single-arm bracket for supporting a single stripper (13), or two opposite arm brackets, each holding a stripper. The latter embodiment is useful in case a stripper is damaged during use of the cyclotron. A 180°-rotation of the rotating axle (11) suffices for bringing a new stripper at the first stripping position, Pi, and continuing extraction. Similarly, a stripper assembly may comprise more than two bracket and stripper combinations azimuthally distributed about the rotating axle (11), as shown in FIGS. 5(*b*) and 5(*e*), with a plate or star-like bracket holding six strippers.

As shown in FIGS. 7(*a*) and 7(*b*), a slight change in the angle β, between the bracket and the cyclotron radius passing by the rotating axle can change the stripping position, Pi or Pj, of the stripper. A given stripper is repeatedly positioned at the same stripping position. As shown in FIGS. 5(*a*)-5(*f*), the rotating axle (11) may comprise a portion having a cross section which is not of revolution, to ensure that the stripper assembly (10*i* or 10*j*) is always mounted onto the cyclotron with the same angular position. The rotating axle may then be rotated for two reasons: first, for bringing a stripper in or out of the corresponding stripping position and, second, for fine tuning the stripping position to optimize the extraction path to intersect the target (20*t*). The mounting position of a stripping assembly is therefore controlled. In FIGS. 5(*a*)-5(*f*), a cylindrical axle with a half-cylindrical top section is illustrated. The axle may have any geometry which is not of revolution, and may have a single angular mounting position.

The first stripper assembly (12*i*) in FIGS. 5(*a*)-5(*c*) differs from the second stripper assembly in FIGS. 5(*d*)-5(*f*) solely on the distances, ri and rj, separating the stripper outer edge from the rotating axle (11). For given acceleration settings, the energy of the particle beam depends on the radial distance, Ri or Rj, from the central axis, Z, of the particle beam in the spiral path (5). The rotating axles (11) of the first and second stripper assemblies are all positioned at a fixed distance, R11, from the central axis, Z. As illustrated in FIG. 4(*b*), mounting a second stripper assembly (10*j*) characterized by a second distance, rj>ri, results in a second stripping position, Pj, at a distance, Rj, from the central axis, Z, smaller than the distance, Ri, separating the first stripping position, Pi, from the central axis, Z. This consequently results in the extraction of a particle beam of second energy, Ej, smaller than the first energy, Ei (i.e., if ri<rj ⇒Ri>Rj, and Ei>Ej). Inversely, if rj<ri⇒Rj>Ri, and Ej>Ei. If the first energy, Ei, is the extraction energy for which the cyclotron was specifically designed, the second energy, Ej, is preferably smaller than the first energy, Ei, because it is likely that the first energy, Ei, corresponds to a very external orbit of large radius, Ri.

The relation between ri−rj, Ri−Rj, and Ei−Ej discussed earlier is visible by comparing FIG. 4(*a*) with 4(*b*) and FIG. 6(*a*) with 6(*d*). In FIGS. 4(*a*), 4(*b*), 6(*a*), and 6(*d*), the particle beam orbit (5) intersecting the stripper is represented by a thick solid line. In FIGS. 4(*a*) and 6(*a*), a particle beam of first energy, Ei, is extracted with a first stripper assembly of first distance, ri. In FIGS. 4(*b*) and 6(*d*), a particle beam of second energy, Ej<Ei, is extracted with a second stripper assembly of second distance, rj>ri. The orbits represented with a thin dashed line in FIGS. 4(*a*), 4(*b*), 6(*a*), and 6(*d*) represent the orbits of beams of energies extracted with the other stripper assembly, for comparison.

The first and second energies, Ei and Ej, may be between 5 and 30 MeV, or, in alternative embodiments, between 10 and 24 MeV, or between 11 and 20 MeV. They may differ from one another by at least 2 MeV (|Ei−Ej|≥2 MeV), or at least 4 MeV (|Ei−Ej|≥4 MeV). For example, if Ei=18 MeV, then the second energy, Ej, may be 12 to 16 MeV. The second energy, Ej, may also be between 20 and 25 MeV, but for the reasons explained earlier, that the first stripping position, Pi, is generally near the periphery of the magnet poles, the second energy, Ej, is generally smaller than the first energy, Ei.

A beam of particles of charge qj after stripping is deviated at a velocity, vj, by a magnetic field, B(r), along a curve with radius of curvature, ρj=m vj/(qj B(r,θ)), wherein r and θ are the cylindrical coordinates of the position of a particle on the median plane, P. At the periphery of the magnet poles (at r>Rj), the magnetic field, B(r), strongly varies and drops with increasing values of the radial distance, r. The extraction path therefore straightens with larger values of the radius of curvature, ρj, as the particle beam moves towards the opening (8*o*). The calculation of an extraction path, Sj, from an extraction position, Pj, such that it crosses the opening (8*o*) is not straightforward, but can be carried out by a person of ordinary skill in the art. Beyond the peripheral wall, the magnetic field, B(r), is quite low, and the extraction path can have quite a large radius of curvature, ρj, of at least 5 m, or, in alternative embodiments, at least 10 m and higher.

The second stripping position, Pj, is carefully positioned to ensure that the second extraction path, Sj, crosses through the opening. As shown in FIGS. 4(*a*), 4(*b*), 6(*a*), and 6(*d*), for the second extraction path, Sj, to cross through the opening (8*o*), it must cross over the first extraction path at a cross-over point located in or adjacent to the opening (8*o*).

Insert (21*j*)

As shown in FIGS. 6(*a*) and 6(*d*), the first extraction path, Si, represented by the thick solid line, crosses at the cross-over point the second extraction path, Sj, represented by the thin dashed line, in or adjacent to the opening (8*o*) and deviates from the latter by an angle, a. The angle, a, is the angle formed by the tangents of the first and second extraction paths, Si and Sj, at the target hitting point. Following the dashed line of the second extraction path, Sj, in FIGS. 6(*a*) and 6(*d*), it can be seen that, although exiting the vacuum chamber through the opening (8*o*), the particle beam of second energy, Ej, would miss the target (20*t*), if the target is not moved from its initial position first.

Assuming the cyclotron was designed for extracting a particle beam of first energy, Ei, a first insert (21*i*) is not necessary, and is not represented in FIGS. 4(*a*) and 6(*a*). If for any reason a first insert were desired (e.g., for bringing the target further away from the central axis, Z), the first insert (21*i*) would have parallel first and second coupling surfaces, defined by an angle, α=0, as illustrated in FIG. 6(*b*).

The solutions proposed in other cyclotrons for ensuring that a particle beam of second energy, Ej, intercepts the target (20*t*), include either the use of bending magnets for bending the second extraction path, Sj, and forcing it to intercept the target (20*t*) or the use of moving means for displacing the target to intercept the second extraction path, Sj. Both options require tuning the positions of the bending magnets or of the target holder to match the second extraction path, which can be a delicate and risky operation, as discussed earlier.

The present disclosure proposes a third solution: the use of an insert (21*j*) to be sandwiched between the downstream end of the opening (8*o*) and the target support element (20) for modifying an orientation of the tubular channel to match the second extraction path, Sj, such that the modified charged particles of second energy, Ej, intercept the target held in the target holder. The insert (21*j*) forms a pair with the second stripper assembly (10*j*) and both are used in combination.

When the insert is mounted on the cyclotron, the insert channel is in fluid communication with both opening (8*o*) and tubular channel (20*c*) of the target support element (20). As can be seen in FIGS. 6(*d*) and 6(*e*) the insert (21*j*) comprises a first coupling surface for coupling to the downstream end of the opening (8*o*); and a second coupling surface for coupling to the target support element (20). The first and second coupling surfaces are not parallel to one another and form the angle, α, discussed earlier between the tangents of the first and second extraction paths downstream of the target hitting point. The angle α is between 1 and 45°, or, in alternative embodiments, between 5° and 20°. The insert channel is normal to the second coupling surface of the insert. When in position, the insert (21*j*) therefore forms an elbow of angle α between the opening (8*o*) and the tubular channel (20*c*), which are coaxial absent the insert, as shown in FIG. 6 (*a*). The tubular channel (20*c*) is thus coaxial with the portion of the second extraction path, Sj, downstream of the opening (8*o*), and the particle beam hits the target (20*t*) with the second energy, Ej. For example, the KIUBE®-cyclotron commercialized by IBA was initially designed for accelerating particles at a first energy, Ei=18 MeV. The second energy specific extraction kit for extracting particles at a second energy, Ej=13 MeV from the KIUBE®-cyclotron comprises an insert (21*j*) characterized by an angle, α=18°. A third energy specific extraction kit for extracting particles at a third energy, Ek, between 13 MeV and 18 MeV comprises an insert characterized by an angle, 0<α<18°.

Energy Specific Extraction Kit

The energy specific extraction kit of the present disclosure comprises two elements: a stripper assembly (10*j*) and an insert (21*j*). The two elements are used in combination, and define a unique ready-to-use kit allowing a particle beam of second energy, Ej, to be extracted and to hit a target (20*t*) using a cyclotron initially designed for extracting a particle beam of first energy, Ei. Apart from fine tuning for the optimization of the extraction path, the installation of the energy specific extraction kit requires no lengthy and delicate determination of the extraction settings required for the extraction of a beam of second energy, Ej.

The installation of an energy specific extraction kit is simple, in that the angular orientation of the stripper assembly can be reproducibly controlled by providing a rotation axle (11) with a portion which is not of revolution as discussed earlier. As there is only one way of mounting the insert, no error can occur.

It is clear that more than one energy specific extraction kit may be used for a same cyclotron. For example, the first energy, Ei, may be the highest beam energy extractable with a given cyclotron, and the second energy, Ej, the lowest beam energy to be extracted with the cyclotron. Any number of third, fourth, or more energy specific extraction kits can be provided for extracting and hitting a target with particle beams at third, fourth, etc. energies, Ek, El, Em, wherein Ej<Ek<El<Em<Ei.

The second stripper assembly (10*j*) ensures that the particle beam (5) is stripped at the second energy, Ej, and that the second extraction path, Sj, exits through the opening (8*o*). The insert (21*j*) ensures that the tubular channel (20*c*) becomes coaxial with the portion of the second extraction path, Sj, downstream of the opening (8*o*), and that the second extraction path intercepts the target held in the target holder. Using a first stripper (10*i*) with an insert (21*j*) is therefore avoided. The two elements of a second energy specific extraction kit belong to a pair. For example, a color code or an alpha-numerical code may be used to identify the two elements of a second energy specific extraction kit.

Cyclotron

With the present disclosure, solid, liquid, or gaseous targets (20*t*) such as $^{68}$Zn, $^{124}$Te, $^{123}$Te, $^{89}$Y, may be irradiated with a single cyclotron with particle beams of various energies, Ei or Ej, allowing the production of different radioisotopes, $^{n}$X, $^{m}$X, with a same target as illustrated in FIG. 3. The present disclosure also allows the selection of the optimal energy for the production of radioisotopes from different target materials.

The cyclotron may be an isochronous cyclotron, or a synchro-cyclotron. As illustrated in FIGS. 1 and 2, in an isochronous cyclotron each of the first and second magnet poles (2) comprise at least N=3 hill sectors (3) having an upper surface (3U) defined by upper surface edges, and a same number of valley sectors (4) comprising a bottom surface (4B). The hill sectors and valley sectors are alternatively distributed around the central axis, Z, such that the gap separating the first and second magnet poles comprises hill gap portions defined between the upper surfaces of two opposite hill sectors and having an average gap height, Gh, measured along the central axis, Z, and valley gap portions defined between the bottom surfaces of two opposite valley sectors and having an average valley gap height, Gv, measured along the central axis, Z, with Gv>Gh.

As shown in FIGS. 2, 4(*a*), and 4(*b*), the rotating axle (11) may be positioned at a hill gap portion, adjacent to an upper surface edge located downstream with respect to the spiral path, i.e., close to the next valley sector (4). This is because the magnetic field, B, is substantially lower in a valley gap portion than in a hill gap portion, thus steering the particle beam along an extraction path of higher radius of curvature. The term "downstream" is herein defined with respect to the motion of the particles.

Hitting a Target with Particle Beams of Different Energies, Ei, Ej

The present disclosure concerns hitting a target (20*t*) with particle beams of first energy, Ei, and of second energy, Ej, and any other energy between Ei and Ej, using a single cyclotron, originally designed for extracting particle beams at the first energy, Ei, only. This can be achieved with a method comprising the following steps:

- providing a cyclotron designed for extracting a particle beam at a first energy, Ei, and steering the particle beam towards the target (20*t*), the cyclotron comprising:
  - a vacuum chamber comprising an opening,
  - a target support element comprising a target holder,
  - a stripping mechanism comprising a first energy specific extraction kit including a first stripper assembly, and
  - a second energy specific extraction kit comprising a bracket, a second stripper assembly, a stripper, and an insert,
- removing the first stripper assembly (10*i*) and removing the target support element (20),
- mounting the bracket (10*j*) and positioning the stripper (13) at a stripping position, Pj,
- mounting the target support element (20) with the insert (21*j*) sandwiched between a downstream end of the opening (8*o*) and the target support element (20),
- positioning the target (20*t*) in the target holder; and
- accelerating a particle beam along a spiral path (5) intersecting the stripping position, Pj, at a second energy, Ej, and extracting the particle beam along an extraction path, Sj, through the opening (8*o*) and onto the target (20*t*).

There is one way only to mount the second stripper assembly (10*j*) and insert (21*j*), and the calculated second extraction path, Sj, necessarily intersects the target position, without requiring any further changes in the extraction settings. The position of the stripper (13) can be fine-tuned by minute rotations of the rotating axle (11), to optimize a hitting point on the target by the particle beam. This fine-tuning may optimize the extraction path as a function of the actual second extraction path of the stripped particle beam which may differ slightly from the calculated extraction path. The present disclosure needs neither a bending magnet for bending the second extraction path, nor articulated target support for moving the target (20*t*) to intersect the second extraction path, Sj, with the target.

The present disclosure therefore opens new horizons in the multiple applications a cyclotron can be used for.

Additionally, the first and second energies, Ei, Ej, can be between 5 and 30 MeV, or, in alternative embodiments, between 10 and 24 MeV, or between 11 and 20 MeV, and they can differ from one another, for example, by at least 2 MeV ($|Ei-Ej|\geq 2$ MeV), or, in alternative embodiments, at least 4 MeV ($|Ei-Ej|\geq 4$ MeV). Such cyclotrons may be used for the production of radioisotopes by irradiation with the accelerated particle beam of a target material selected among 68Zn, $^{124}$Te, $^{123}$Te, $^{89}$Y, and the like.

A second energy specific extraction kit according to the present disclosure comprises a stripper assembly and an insert. The one or more first and second brackets of the first and second stripper assemblies may comprise a frame-like structure for fastening the first or second stripper, and an arm or plate for keeping the fastened first or second stripper at an accurate distance, ri, rj, from the first or second rotating axle The first and/or second stripper assemblies may comprise more than one frame azimuthally distributed about the first or second rotating axle, each holding a stripper foil.

The insert may comprise a first coupling surface for coupling to the downstream end of the opening, and a second coupling surface for coupling to the target support element. The first and second coupling surfaces are not parallel to one another and form an angle, α, between 1° and 45°, or, in alternative embodiments, between 3° and 35°, or between 5° and 20°.

The cyclotron may comprise a first insert to be used with the first stripping assembly, comprising a first coupling surface for coupling to the downstream end of the opening, and a second coupling surface for coupling to the target support element, and wherein the first and second coupling surfaces are parallel to one another. Such first insert is optional and serves only to move the target along the first extraction path, Si, to a position more remote from the central axis, Z.

Because they are used in combination, the second stripper assembly and the insert of a second energy specific extraction kit may be identified by a color code or an alpha-numerical code as forming a pair. This should avoid mixing by error a first stripper assembly with an insert designed for a second energy, Ej.

The present disclosure may be implemented in synchro-cyclotrons as well as isochronous cyclotrons. Each of the first and second magnet poles of the cyclotron may comprise at least N=3 hill sectors having an upper surface defined by upper surface edges, and a same number of valley sectors comprising a bottom surface. The hill sectors and valley sectors are alternatively distributed around the central axis, Z. A gap separating the first and second magnet poles thus comprises hill gap portions and valley gap portions. The hill gap portions are defined between the upper surfaces of two opposite hill sectors and have an average gap height, Gh, measured along the central axis, Z. The valley gap portions are defined between the bottom surfaces of two opposite valley sectors and have an average valley gap height, Gv, measured along the central axis, Z, with Gv>Gh. In such cyclotrons, the first or second rotating axle of the first or second stripper assemblies may be positioned at a hill gap portion, adjacent to an upper surface edge located downstream with respect to the spiral path. The term "downstream" is defined with respect to the flow direction of particles.

In alternative embodiments, the position of the second stripper can be fine-tuned by minute rotations of the second rotating axle to optimize a hitting point on the target by the particle beam.

The invention claimed is:

1. A cyclotron for accelerating a beam of charged particles over an outward spiral path until the beam of charged particles reaches a desired energy, and for extracting the beam to hit a target, the cyclotron comprising:

a vacuum chamber defined by a gap separating first and second magnet poles centered on a central axis, Z, and symmetrically positioned opposite to one another with respect to a median plane, P, normal to the central axis, Z, and by a peripheral wall sealing the gap and allowing drawing of a vacuum in the gap, the peripheral wall comprising an opening;

a target support element sealed and coupled to a downstream end of the opening, outside the vacuum chamber, the target support element comprising a tubular channel in fluid communication with the opening and ending at a target holder for holding a target;

a stripping mechanism for receiving and controlling a position of a first energy extraction kit including a first stripper assembly in the gap, the first stripper assembly comprising:

a first rotating axle provided with one or more first brackets, each first bracket holding a first stripper having an outer edge at a first distance, ri, from the first rotating axle such that the first rotating axle is parallel to the central axis, Z, and such that the first stripper can rotate about the first rotating axle to a first stripping position, Pi, intercepting the beam of charged particles at a first energy, Ei, modifying the charge of the particles traversing the first stripper and steering the thus modified charged particles along a first extraction path, Si, through the opening in the peripheral gap wall, along the tubular channel, and towards the target holder; and a second energy extraction kit for driving a beam of modified charged particles of a second energy, Ej, along a second extraction path, Sj, through the opening in the peripheral wall, along the tubular channel, and towards the target holder, wherein the second energy extraction kit comprises:

a second stripper assembly including:

a second rotating axle provided with one or more second brackets, each second bracket holding a second stripper having an outer edge at a second distance, rj, from the second rotating axle, such that the second stripper can rotate about the second rotating axle to a second stripping position, Pj, intercepting the beam of charged particles at the second energy, Ej, modifying the charge of the particles traversing the second stripper and driving the thus modified charged particles along a second modified path, Sj, through the opening in the peripheral wall; and an insert to be sandwiched between a downstream end of the opening and the target support element with an insert channel in fluid communication with both the opening and the tubular channel, for modifying an orientation of the tubular channel to match the second extraction path, Sj, such that the modified charged particles of second energy, Ej, intercept the target holder.

2. The cyclotron according to claim 1, wherein the first and second energies, Ei, Ej, are between 5 and 30 MeV.

3. The cyclotron according to claim 1, wherein the first and second energies, Ei, Ej, differ from one another by at least 2 MeV ($|Ei\ Ej| \geq 2$ MeV).

4. The cyclotron according to claim 1, wherein the beam of modified charged particles are selected among $H^-$, $D^-$, $HH^+$.

5. The cyclotron according to claim 1, wherein the target is selected among $^{68}Zn$, $^{124}Te$, $^{123}Te$, $^{89}Y$, for the production of radioisotopes.

6. The cyclotron according to claim 1, wherein the one or more first and second brackets comprise a frame-like structure for fastening the first or second stripper, and an arm or plate for keeping the fastened first or second stripper at an accurate distance from the first or second rotating axle.

7. The cyclotron according to claim 6, wherein the first or second stripper assemblies comprise more than one frame azimuthally distributed about the first or second rotating axle.

8. The cyclotron according to claim 1, wherein the insert comprises a first coupling surface for coupling to the downstream end of the opening, and a second coupling surface for coupling to the target support element, and wherein the first and second coupling surfaces are not parallel to one another and form an angle between 1° and 45°.

9. The cyclotron according to claim 1, further comprising a first insert to be used with the first stripping assembly, the first insert comprising a first coupling surface for coupling to the downstream end of the opening, and a second coupling surface for coupling to the target support element, and wherein the first and second coupling surfaces are parallel to one another.

10. The cyclotron according to claim 1, wherein the second stripper assembly and the insert of the second energy extraction kit are identified by a color code or an alphanumerical code as forming a pair.

11. The cyclotron according to claim 1, wherein each of the first and second magnet poles comprises at least N=3 hill sectors having an upper surface defined by upper surface edges, and a same number of valley sectors comprising a bottom surface, the hill sectors and valley sectors being alternatively distributed around the central axis, Z, such that a gap separating the first and second magnet poles comprises hill gap portions defined between the upper surfaces of two opposite hill sectors and having an average gap height, Gh, measured along the central axis, Z, and valley gap portions defined between the bottom surfaces of two opposite valley sectors and having an average valley gap height, Gv, measured along the central axis, Z, with Gv>Gh; and the first or second rotating axle is positioned at a hill gap portion, adjacent to an upper surface edge located downstream with respect to the spiral path.

12. A method for hitting a target with a particle beam of second energy, Ej, comprising the steps of:

providing a cyclotron configured for extracting a particle beam of a first energy, Ei, and steering the particle beam towards a target, the cyclotron comprising:

a vacuum chamber comprising an opening, a target support element comprising a target holder, a stripping mechanism comprising a first energy extraction kit including a first stripper assembly, and a second energy extraction kit comprising a bracket, a second stripper assembly, a stripper, and an insert;

removing the first stripper assembly and removing the target support element;

mounting the bracket and positioning the stripper at a stripping position, Pj;

mounting the target support element with the insert sandwiched between a downstream end of the opening and the target support element;

positioning the target in the target holder; and accelerating a particle beam along a spiral path intersecting the stripping position, Pj, at the second energy, Ej, and extracting the particle beam along an extraction path, Sj, through the opening and onto the target.

13. The method according to claim 12, wherein the position of the stripper is fine-tuned by minute rotations of a rotating axle to optimize a hitting point on the target by the particle beam.

* * * * *